US008348868B1

(12) United States Patent
Severence

(10) Patent No.: US 8,348,868 B1
(45) Date of Patent: Jan. 8, 2013

(54) LEG SLING DEVICE

(76) Inventor: Thomas A. Severence, Dawsonville, GA (US)

( * ) Notice: Subject to any disclaimer, the term of this patent is extended or adjusted under 35 U.S.C. 154(b) by 435 days.

(21) Appl. No.: 12/708,373

(22) Filed: Feb. 18, 2010

(51) Int. Cl.
*A61H 1/00* (2006.01)

(52) U.S. Cl. ..... 601/27; 601/26; 601/34

(58) Field of Classification Search ..... 601/22, 601/27, 28, 32–34, 104; 602/28, 29, 62
See application file for complete search history.

(56) References Cited

U.S. PATENT DOCUMENTS

| | | | | |
|---|---|---|---|---|
| 4,251,070 | A | 2/1981 | Leseberg | |
| 5,518,486 | A | 5/1996 | Sheeler | |
| 5,865,203 | A * | 2/1999 | Villano | 135/65 |
| 6,004,282 | A | 12/1999 | Whitley | |
| 6,027,434 | A | 2/2000 | Gibbons | |
| 6,361,517 | B1 | 3/2002 | Slinger | |
| 6,666,796 | B1 * | 12/2003 | MacCready, Jr. | 482/51 |
| D500,138 | S | 12/2004 | Urban et al. | |
| 7,007,708 | B2 | 3/2006 | Burke et al. | |
| 7,153,242 | B2 * | 12/2006 | Goffer | 482/66 |
| 7,416,538 | B2 * | 8/2008 | Katoh et al. | 602/16 |
| 7,740,566 | B2 * | 6/2010 | Nativ | 482/68 |
| 8,147,436 | B2 * | 4/2012 | Agrawal et al. | 602/16 |
| 2002/0183670 | A1 | 12/2002 | Driver, Jr. | |
| 2003/0213510 | A1 | 11/2003 | MacCready et al. | |
| 2006/0167392 | A1 | 7/2006 | Manquez | |
| 2006/0276728 | A1 * | 12/2006 | Ashihara et al. | 601/5 |

OTHER PUBLICATIONS

Patterson Medical; catalogue; pp. 1172-1174.

* cited by examiner

*Primary Examiner* — Nicholas Lucchesi
*Assistant Examiner* — Gerald Landry, II

(57) ABSTRACT

A leg sling device featuring a foot platform for supporting a user's foot; two half straps extending upwardly from sides of the foot platform, the tops of the half straps connect via a barrel; a hand base having an opening for accommodate the user's fingers; a reel disposed in the hand base; a cable having a first end wrapped around the reel in the hand base and a second end attached to the barrel that connects the half straps; and a motor and control buttons operatively connected to the reel, the motor and control buttons function to rotate the reel in a first direction to retract the cable into the hand base thereby raising the foot platform and a second direction to extend the cable out of the hand base thereby lowering the foot platform.

8 Claims, 5 Drawing Sheets

LEG SLING DEVICE

FIELD OF THE INVENTION

The present invention is directed to a sling-like device for lifting a user's leg, for example when the user is walking or climbing stairs.

BACKGROUND OF THE INVENTION

Individuals with injured legs, feet, ankles, and knees can have great difficulty lifting their legs to walk uphill or up stairs. The present invention features a leg sling device. The leg sling device of the present invention helps a user walk more easily with an injured leg and can help eliminate the need for a user to push down on a cane when walking uphill or up stairs. In some embodiments, the device can help relieve pain.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-5, the present invention features a leg sling device 100 for helping to lift a user's leg when walking or climbing stairs. Without wishing to limit the present invention to any theory or mechanism, it is believed that the leg sling device 100 of the present invention is advantageous because it can help take pressure off pressing down on a cane when walking.

The leg sling device 100 of the present invention comprises a foot platform 110 on which a user can place his/her foot. A first half strap 120*a* extends upwardly from a first side of the foot platform 110 and a second half strap 120*b* extends upwardly from a second side of the foot platform 110. The half straps 120 meet and connect a distance above the foot platform 110. In some embodiments, the half straps 120 are connected via a connecting component (e.g., a barrel 125). In some embodiments, the foot platform 110 comprises side walls (e.g., volcano-shaped side walls).

Figure 4:
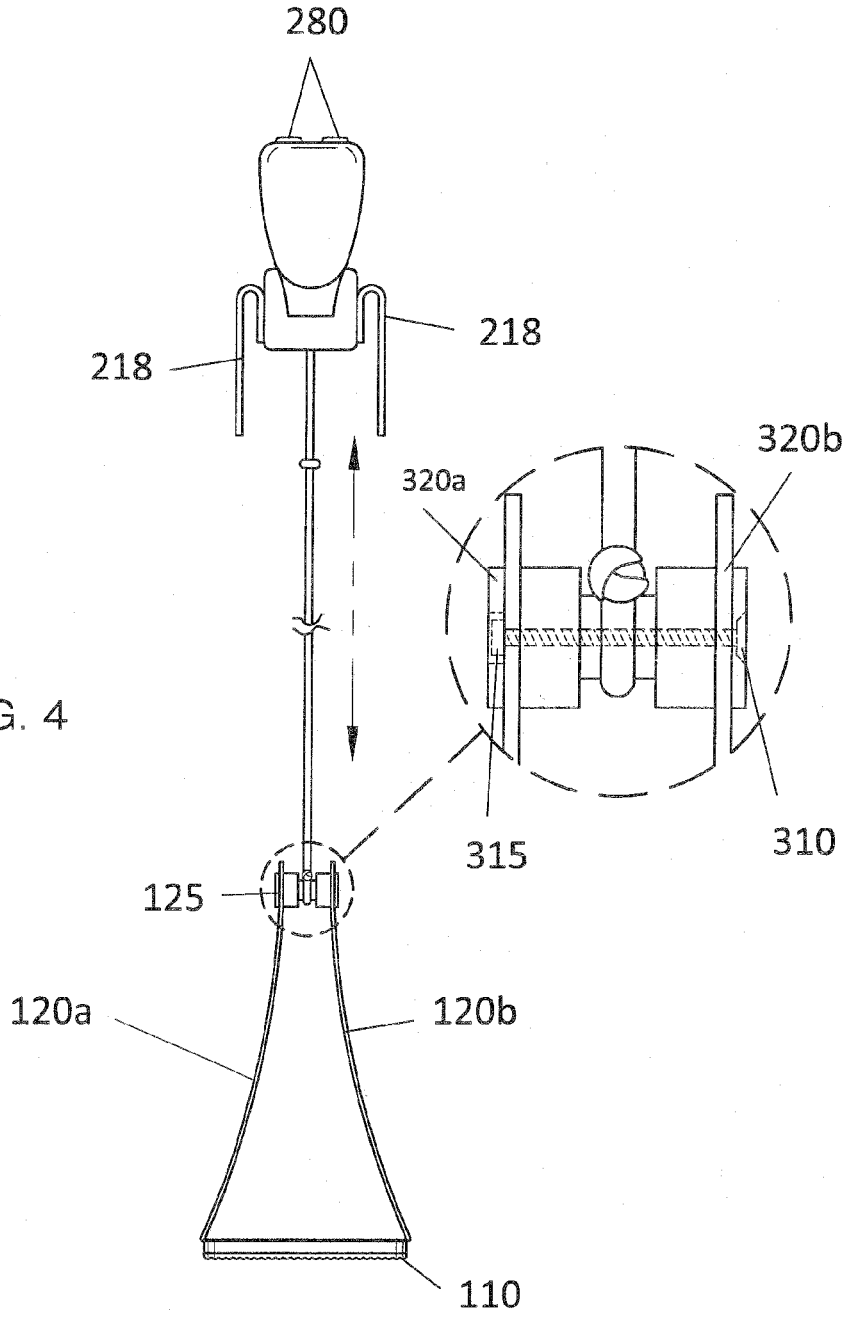
FIG. 4 is a front view of the leg sling device of FIG. 1.
Figure 5:
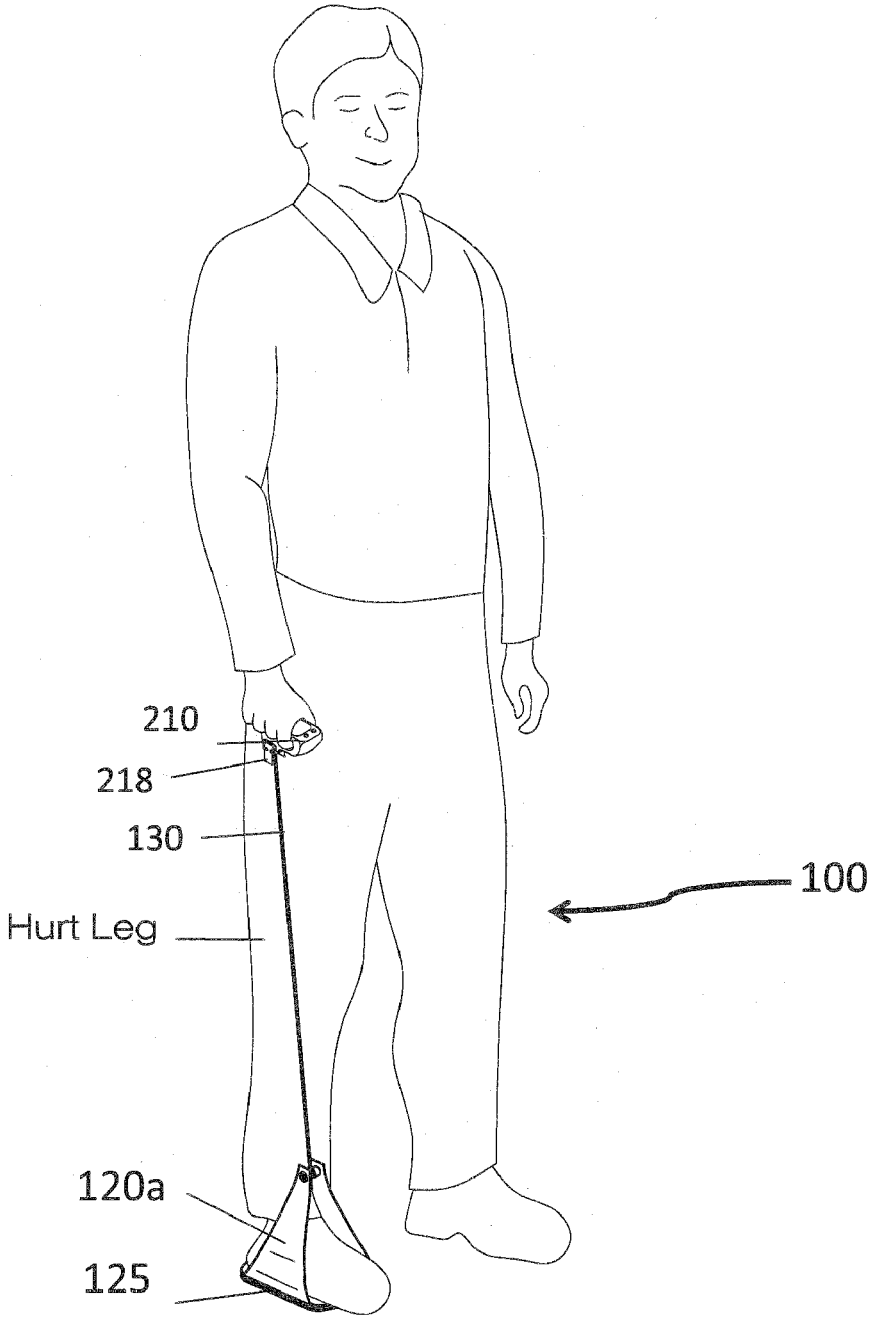
FIG. 5 is an in-use view of the leg sling device of the present invention.

As shown in FIG. 4, the connecting component (e.g., barrel 125) may comprise a countersunk bolt 310 having a first end and a second end. The first end of the countersunk bolt 310 engages a first washer 320*a* disposed in the first half strap 120*a* and the second end of the countersunk bolt 310 engages a second washer 320*b* disposed in the second half strap 120*b*. In some embodiments, a lock nut 315 secures the countersunk bolt 310 in the washers 320. The countersunk bolt 310 separates the two half straps 120 while keeping them connected. This allows a user to easily insert and remove his/her foot from the foot platform 100.

The half straps 120 may be constructed from a variety of materials, for example a material comprising vinyl, nylon, the like, or a combination thereof. In some embodiments, a skid-proof material 118 such as carpet, mesh, rubber, and/or the like is disposed on the foot platform 110 for helping the keep the user's foot secured on the foot platform 110. In some embodiments, a pad is disposed on the foot platform 110. In some embodiments, the foot platform 110 is constructed form a material comprising rubber. The foot platform 110 may be constructed in a variety of sizes, for example small, medium, large, extra large, etc.

In some embodiments, one or more securing components may be disposed on the straps 120 and/or on the foot platform 110. The securing components may include a hook-and-loop fastener mechanism, clasp mechanism, button mechanism, snap mechanisms, adhesive mechanisms, the like, or a combination thereof. The securing components (e.g., hook-and-loop fasteners) may be about 3 inches in length. The securing components may help to secure a user's leg in the strap 120 and/or in the foot platform 110.

The leg sling device 100 of the present invention further comprises a cable 130 having a first end and a second end. The second end is attached to the half straps 120 and/or the connecting component (e.g., barrel 125). In some embodiments, the second end of the cable 130 is attached to the countersunk bolt 310 of the connecting component (e.g., barrel 125). The first end of the cable 130 is attached to a hand base 210. The hand base 210 has a top surface and a bottom section 250, wherein an inner cavity is disposed in the bottom section 250.

The hand base 210 is the component a user can grip and manipulate the positioning of the foot platform 110. The palm of the user's hand is placed over the top surface of the hand base 210. The hand base 210 comprises an opening 220 adapted to accommodate a user's fingers. The opening 220 may separate the top surface and the bottom housing of the hand base 210. In some embodiments, the opening 220 is lined with ridges (e.g., finger grips, cushioned finger grips) for providing a comfortable grip for the user (and an ergonomic grip). In some embodiments, a pad 230 (e.g., foam pad) is disposed on the top surface of the hand base 210 for providing comfort to the user when he/she grips the hand base 210.

The first end of the cable 130 is attached to a reel 260 disposed in the inner cavity of the bottom section 250 of the hand base 210. The cable 130 may be extended from and retracted into the housing via an automated motor-driven system. Motor-driven systems for manipulating cords and cables about a reel are well known to one of ordinary skill in the art. In some embodiments, the cable 130 is about 4 feet in length. In some embodiments, the cable 130 is more than about 4 feet in length.

Figure 1:
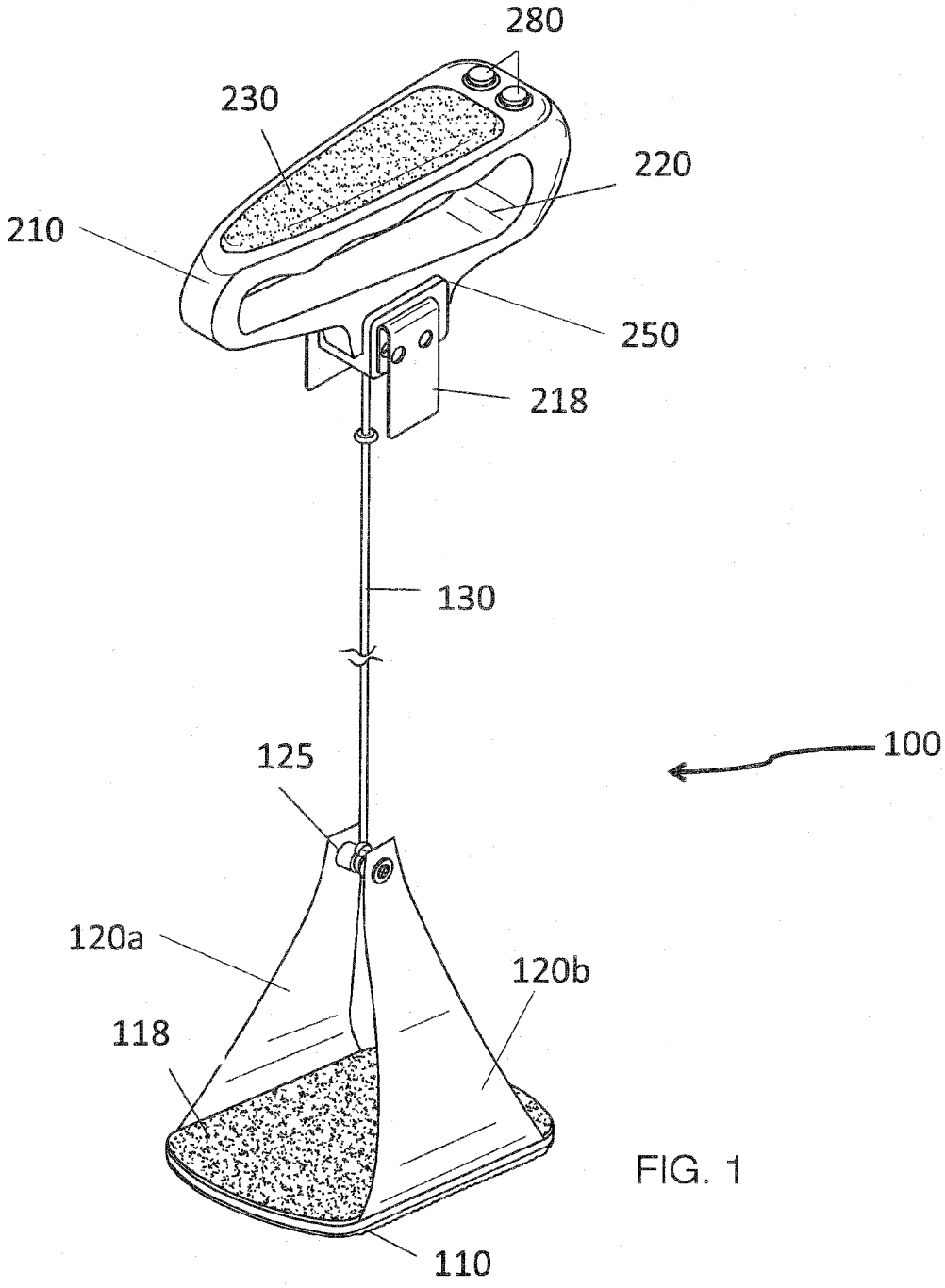
FIG. 1 is a of the leg sling device of the present invention.
Figure 2:
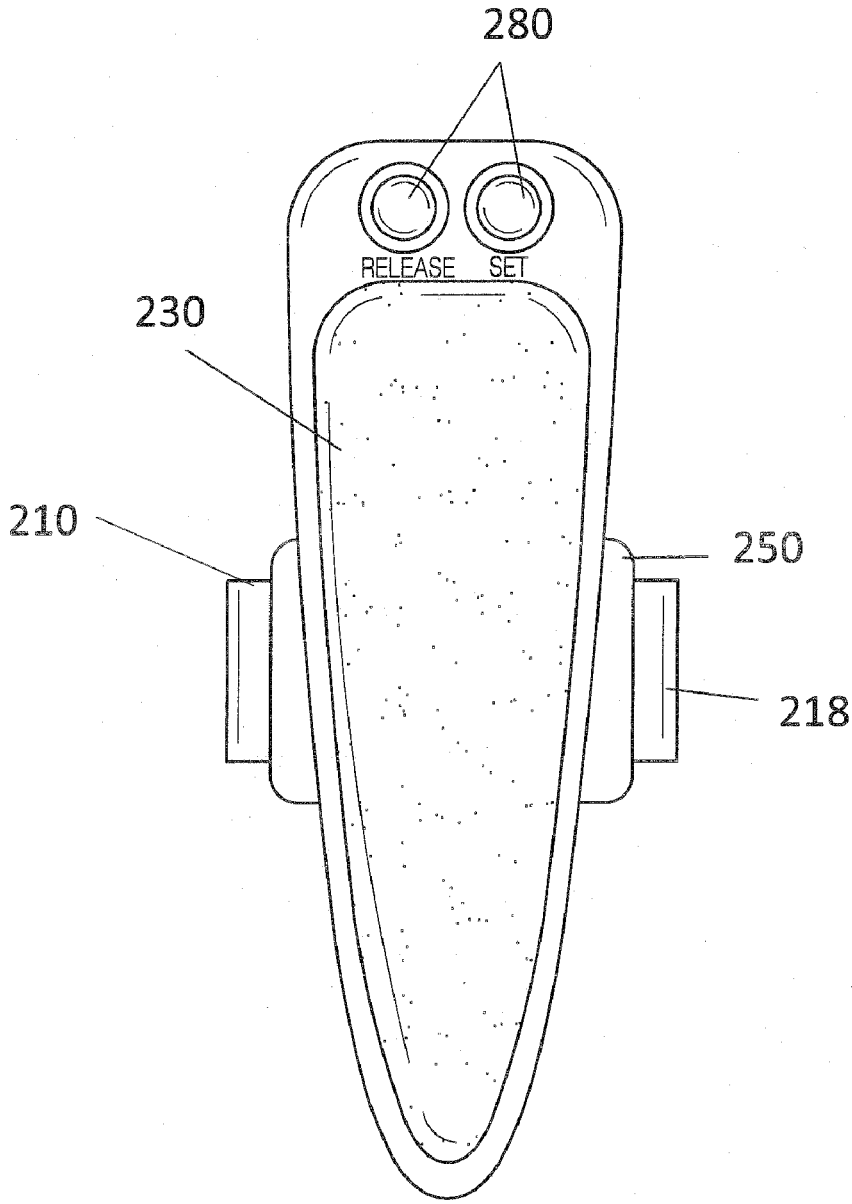
FIG. 2 is a top view of the leg sling device of FIG. 1.
Figure 3:
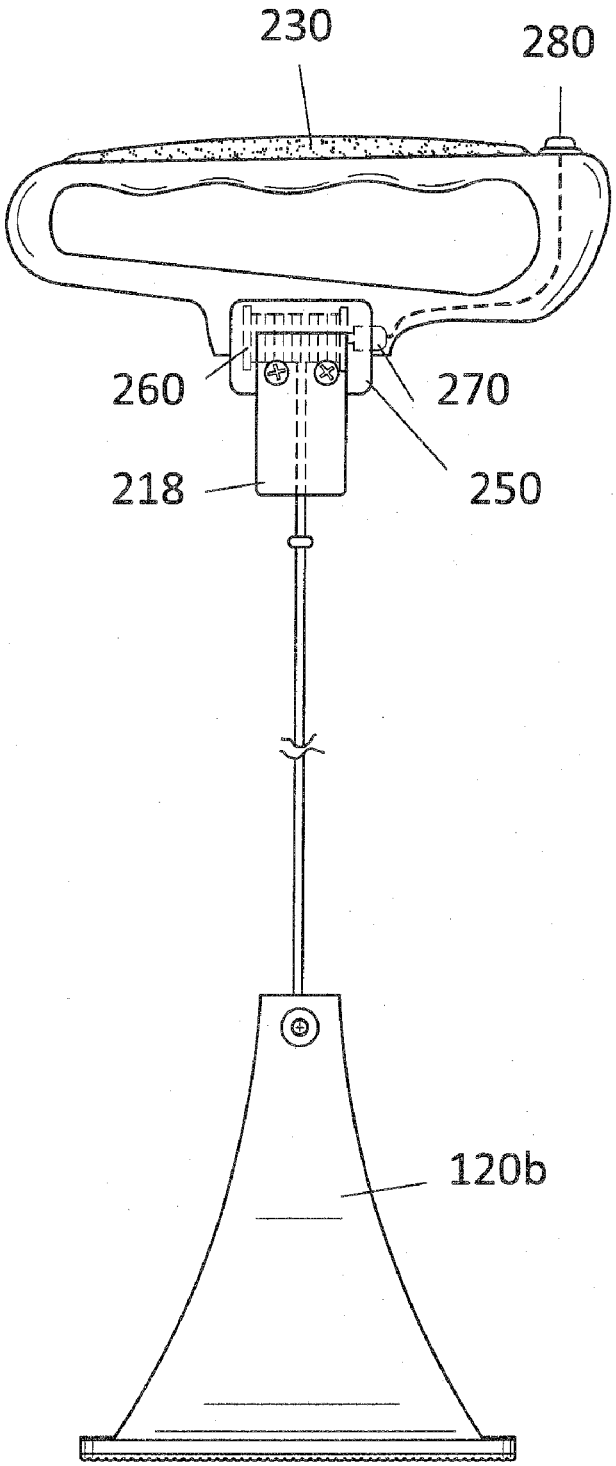
FIG. 3 is a side view of the leg sling device of FIG. 1.

As shown in FIG. 3, the reel 260 is disposed in the bottom section 250 of the hand base 210. The cable 130 is wrapped around the reel 260. A motor 270 is operatively connected to the reel 260. The motor 270 functions to rotate the reel in a first direction to shorten the length of the cable 130 (and raise the foot platform 110) and a second direction to increase the length of the cable 130 (and lower the foot platform).

In some embodiments, a belt clip 218 is disposed on the hand base 210 for allowing a user to clip the hand base 210 to his/her pants or other object when not in use. As shown in FIG. 4, the belt clip 218 may be disposed on one or both sides of the hand base 210. In some embodiments, the belt clip 218 comprises screw holes that allow it to be secured to the hand base 210 via screws.

The leg sling device 100 of the present invention further comprises a set of control buttons 280 disposed on the hand base 210. The control buttons 280 allow a user to adjust the length of the cable 130 and position of the foot platform 110. In some embodiments, the control buttons 280 are disposed on the top surface of the hand base 210. The control buttons 280 are operatively connected to the motor 270, which manipulates rotation of the reel 260. In some embodiments, the control buttons 280 include a down button causing the cable to extend out of the hand base 210 and lower the foot platform 110, an up button causing the cable to retract back into the hand base 210 and raise the foot platform 110, and/or a stop button for stopping the movement of the cable 130.

To use the device 100 of the present invention, a user can place his/her foot on the foot platform 110 and in between the half straps 120. The user can adjust the length of the cable 130 (e.g., via control buttons 280 on the hand base 210). The device 100 may then be used to lift the user's leg while he/she is walking and climbing stairs as needed. The motor 270, reel 260, and cable 130 provide an automated means of manipulating the height of the user's foot.

In some embodiments, a stopper is disposed on the cable 130 to help prevent the cable 130 from being retracted too far into the hand base 210.

As used herein, the term "about" refers to plus or minus 10% of the referenced number. For example, an embodiment wherein the cable 130 is about 4 feet in length includes a cable 130 that is between 3.6 and 4.4 feet in length.

The following the disclosures of the following U.S. patents are incorporated in their entirety by reference herein: U.S. Pat. No. 7,007,705; U.S. Pat. Application No. 2006/0167392; U.S. Pat. Application No. 2002/0183670; U.S. Pat. No. 6,027,434; U.S. Pat. No. 6,004,282; U.S. Pat. Application No. 2003/0213510; U.S. Pat. No. 6,361,517; U.S. Pat. No. 5,518,486; U.S. Pat. No. 4,251,070.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A leg sling device comprising:

(a) a foot platform for supporting a foot of a user;

(b) a first half strap extending upwardly from a first side of the foot platform and a second half strap extending upwardly from a second side of the foot platform, the half straps connect via a barrel above the foot platform;

(c) a hand base having a top surface and a bottom section, wherein an opening is disposed in the hand base separating the top surface and the bottom section, the opening is adapted to accommodate fingers of the user;

(d) a reel disposed in the bottom section of the hand base;

(e) a cable having a first end and a second end, the first end is wrapped around the reel in the hand base, the second end is attached to the barrel that connects the half straps;

(f) a motor operatively connected to the reel, the motor functions to rotate the reel in a first direction to retract the cable into the hand base thereby raising the foot platform and a second direction to extend the cable out of the hand base thereby lowering the foot platform; and (g) a set of control buttons operatively connected to the motor, the control buttons are disposed on the hand base, wherein the control buttons function to cause the motor to rotate the reel in the first direction or second direction, or to cause the motor to stop rotating the reel.

2. The leg sling device of claim 1, wherein the foot platform is constructed from a material comprising carpet, rubber, mesh, foam, or a combination thereof.

3. The leg sling device of claim 1 further comprising a pad disposed on the foot platform.

4. The leg sling device of claim 1, wherein the barrel comprises a countersunk bolt having a first end and a second end, the first end of the countersunk bolt engages a first washer disposed in the first half strap and the second end of the countersunk bolt engages a second washer disposed in the second half strap.

5. The leg sling device of claim 1, wherein the opening is lined with ridges for providing a comfortable grip for the user.

6. The leg sling device of claim 1 further comprising a pad disposed on the top surface of the hand base.

7. The leg sling device of claim 1 further comprising a belt clip disposed on the hand base for allowing a user to clip the hand base to a pair of pants or other object.

8. The leg sling device of claim 1, wherein the control buttons are disposed on the top surface of the hand base.

* * * * *